United States Patent [19]

Katoh et al.

[11] Patent Number: 4,834,031

[45] Date of Patent: May 30, 1989

[54] VARIABLE COMPRESSION-RATIO CONTROL DEVICE FOR AN INTERNAL COMBUSTION ENGINE

[75] Inventors: Kenji Katoh, Suntou; Takao Naruoka, Mishima; Eiji Iwasaki, Susono, all of Japan

[73] Assignee: Toyota Jidosha Kabushiki Kaisha, Toyota, Japan

[21] Appl. No.: 218,256

[22] Filed: Jul. 13, 1988

[30] Foreign Application Priority Data

Jul. 30, 1987 [JP] Japan ..... 62-188806

[51] Int. Cl.[4] ..... F02B 75/04

[52] U.S. Cl. ..... 123/48 R; 73/117.3

[58] Field of Search ..... 123/48 R, 48 D, 78 R, 123/78 D; 73/115, 117.3, 117.2

[56] References Cited

U.S. PATENT DOCUMENTS 4,375,672 3/1983 Kato et al. ..... 73/117.2
4,505,152 3/1985 Haddox ..... 73/115
4,687,348 8/1987 Naruoka et al. ..... 123/48 B

FOREIGN PATENT DOCUMENTS 58-137832 9/1983 Japan .
58-172431 10/1983 Japan .
62-142860 6/1987 Japan .
63-105244 5/1988 Japan .

*Primary Examiner*—David A. Okonsky
*Attorney, Agent, or Firm*—Cushman, Darby & Cushman

[57] ABSTRACT

A variable compression ratio control device includes a mechanism for varying a compression ratio of an engine in response to engine driving conditions, at least between a higher stage and a lower stage, a compression ratio detecting sensor for detecting a current compression ratio, a sensor fault detecting unit for detecting a malfunction of the compression ratio detecting sensor, and a fail-safe unit for lowering and fixing the compression ratio when the sensor fault detecting unit detects a malfunction of the compression ratio detecting sensor.

10 Claims, 11 Drawing Sheets

| | |
|---|---|
| Fig. 4A | |
| Fig. 4B | Fig. 4C |

| Fig. 7A | Fig. 7B | Fig. 7C |
|---|---|---|

VARIABLE COMPRESSION-RATIO CONTROL DEVICE FOR AN INTERNAL COMBUSTION ENGINE

BACKGROUND OF THE INVENTION

1. Field of the Invention

The present invention relates to a variable compression ratio control device for an internal combustion engine, including a mechanism for varying the compression ratio of an engine in response to engine driving conditions.

2. Description of the Related Art

In an internal combustion engine, desirably the compression ratio is increased to bring an improved fuel efficiency and an increased axial torque. Nevertheless, any increase of the compression ratio is limited because it will increase the probability of knocking in the engine when the gas in the combustion chamber is adiabatically compressed and the temperature of the gas is high. Knocking occurs under a high engine load more than under a low engine load, and therefore, desirably the compression ratio is varied in accordance with the engine load, i.e., the compression ratio is high under a low engine load and low under a high engine load.

To satisfy these requirements, various compression ratio varying devices have been proposed for an internal combustion engine in, for example, Japanese Unexamined Patent Publication No. 62-142860 and Japanese Unexamined Patent publication No. 63-105244, and in the above compression ratio varying devices, an ignition timing is determined from the engine load and from an actual compression ratio detected by a compression ratio detecting means such as a combustion pressure sensor or a piston position sensor for detecting the TDC of a piston, of wherein the level of the output signal of the sensors corresponds to the compression ratio.

In detail, in a device which includes a mechanism for varying the compression ratio in two stages, e.g., high and low, if the engine is driven at a high compression ratio, the ignition timing is determined from an ignition map for the high compression ratio, in which the ignition timing is usually delayed, to thereby decrease the tendency toward knocking. On the other hand, if the engine is driven at a low compression ratio, the ignition timing is determined from another ignition map for the low compression ratio, in which the ignition timing is usually advanced, to thereby improve the combustion.

Nevertheless, in the conventional control devices described above, if the compression ratio detecting means such as a combustion pressure sensor or piston position sensor have a failure by malfunction and thus do not operate normally, i.e., if the above sensors generate an output signal level corresponding to the low compression ratio although a high compression ratio state actually exists, the control device will erroneously employ the ignition map for the low compression ratio in which ignition timing is usually advanced, and thus the drivability will be adversely affected by a loss of power from the engine and it is possible for the engine to suffer serious damage due to the resultant increase in the knocking.

SUMMARY OF THE INVENTION

An object of the present invention is to solve the above problems by producing a fail-safe combustion condition of the engine when the compression ratio detecting means malfunctions and therefore the output signal level thereof is not in accordance with an actual compression ratio.

The above object is achieved, according to the present invention, by providing a variable compression ratio control device for an internal combustion engine having a mechanism for varying compression ratio of the engine in response to engine driving conditions at least between a first higher stage and a second lower stage, and a compression ratio detecting means for detecting a current compression ratio; said device comprising;

a sensor fault detecting means for detecting a malfunction of said compression ratio detecting means, and a fail-safe means for varying and fixing the compression ratio to the lower stage when said sensor fault detecting means detects a malfunction of said compression ratio detecting means.

In the device having the above construction, when the compression ratio detecting means malfunctions, the device ceases to control the compression ratio in response to the engine driving conditions, but varies and fixes the current compression ratio to a lower compression ratio. As a result, even if the engine is erroneously started while the ignition timing is advanced for a high compression ratio, an increase in the knocking is prevented by the change to a lower compression ratio.

DESCRIPTION OF THE PREFERRED EMBODIMENT

Figure 1:
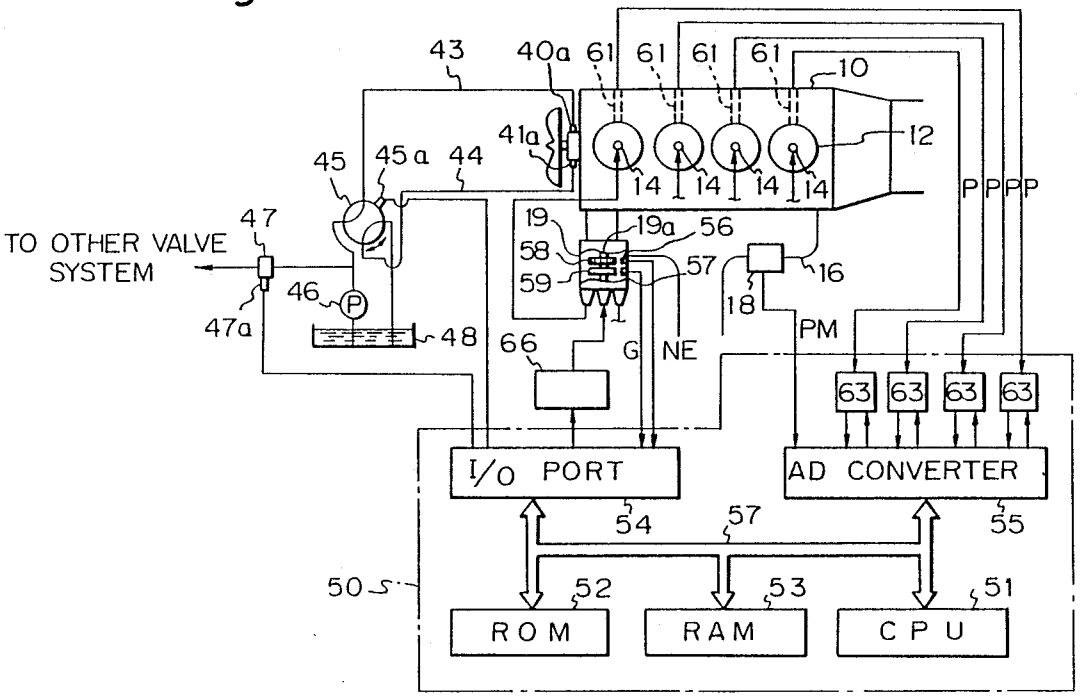
FIG. 1 is a schematic view of an internal combustion engine provided with a variable compression ratio control device according to a first embodiment of the present invention is applied.

Referring to FIG. 1, 10 designates a body of an internal combustion engine, 12 a combustion chamber, 14 a spark plug, 16 an intake pipe, 18 a vacuum sensor for detecting an intake pressure in the intake pipe 16, and 19 a distributor.

Figure 2:
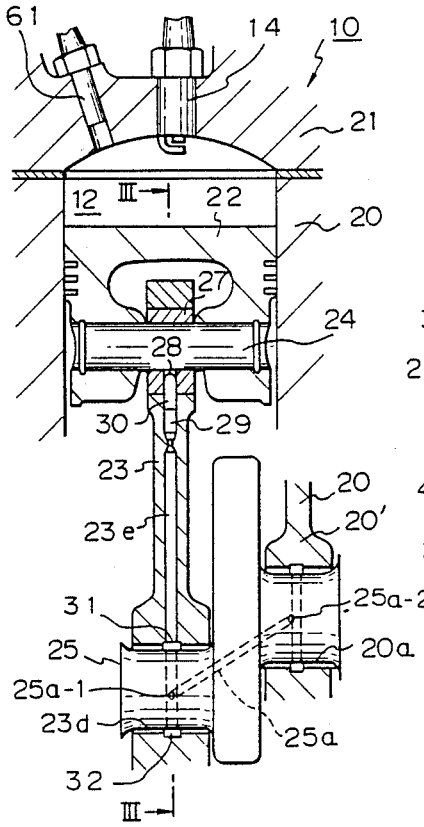
FIG. 2 is a cross-sectional view of one combustion chamber in FIG. 1.
Figure 3:
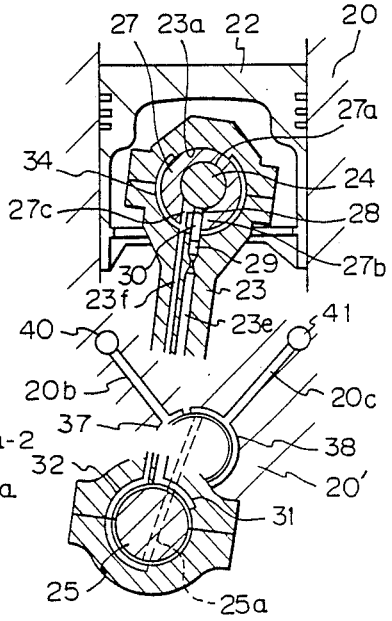
FIG. 3 is a cross-sectional view taken along the line III—III in FIG. 2.

FIGS. 2 and 3 are cross-sectional views of one of the combustion chambers 12 illustrated in FIG. 1. In these figures, 20 designates a cylinder block, 21 a cylinder head, 22 a piston, 23 a connecting rod, 24 a piston pin, and 25 a crankshaft.

The illustrated internal combustion engine includes a mechanism for varying a compression ratio in two stages, which will be described hereinafter. Namely, in this mechanism, the connecting rod 23 is provided with a bore **23*a* in the upper portion thereof, in which an eccentric bearing 27 is rotatably fitted. The bearing 27 is provided with an eccentric bore 27***a* into which the piston pin 24 is inserted. A lock hole 28 which slidably receives a lock-pin 30 therein is provided in a portion 27*b* having the largest thickness of the bearing 27, and extending outward in the radial direction from the bore 27*a*.

A lock-pin hole 29 is provided in the upper portion of the connecting rod 23, and extends from the bore 23*a* towards the crankshaft 25, and received a lock-pin 30 slidably therein.

As illustrated in FIG. 3, in a rotating position of the bearing 27, in which the portion 27*b* having the largest thickness thereof faces the crankshaft 25, the lock hole 28 of the bearing 27 is aligned with the lock-pin hole 29 of the connecting rod 23, and thus, in the above position, the lock pin 30 can be engaged in both the hole 28 and the hole 29, to thereby restrict the free rotation of the bearing 27.

To lock or unlock the lock pin 30 in the hole 28 of the bearing 27, two oil passage systems are provided in this mechanism. In these oil passage systems, two bow-shaped oil grooves 31 and 32 are formed in an internal face of a bore 23*d* into which the crankshaft 25 is rotatably inserted, these grooves 31 and 32 being arranged so as to be independent of each other in the circumferential direction of the bore 23*d*.

Namely, the groove 31 is communicated with the hole 29 via a longitudinal oil passage 23*e* formed in the connecting rod 23, and the groove 32 is communicated with a bow-shaped oil groove 34 formed along the bore 23*a* via a longitudinal oil passage 23f independent of the above passage 23*e*.

An oil passage 27*c* is provided in the bearing 27 in parallel to the hole 28, whereby the passage 27*c* is communicated with the bow-shaped oil groove 34 within a specific range of the bore 23*a*.

The crankshaft 25 is provided with an oil passage 25*a* extending traversely in the crankshaft 25 and opening to the bore 23*d* at one end 25*a*-1. Therefore, the oil passage 25*a* will be alternately communicated with the grooves 31 and 32 as the crankshaft 25 is rotated. The oil passage 25*a* is open at the other end 25*a*-2 thereof to a bore 20*a* in a crankshaft bearing part 20' of the cylinder block 20. Similar to the bow-shaped oil grooves 31 and 32 described above, two bow-shaped grooves 37 and 38 are provided in an internal face of the bore 20*a*, thereby allowing the oil passage 25*a* to be alternately communicated with the grooves 37 and 38 as the crankshaft 25 is rotated. Namely, during the rotation of the crankshaft 25, the oil passage 25*a* is communicated with the groove 37 in the crankshaft bearing part 20' and the groove 31 in the connecting rod 23, and is communicated with the groove 38 and the groove 32, alternately.

Furthermore, the grooves 37 and 38 are connected to an oil passage 40 for the high compression ratio and an oil passage 41 for the low compression ratio through oil passages 20*b* and 20*c* formed in the cylinder block 20, which correspond to the oil passages 40 and 41, respectively.

The above-described mechanism for varying the compression ratio of the engine operates as follows.

As illustrated in FIG. 1 and FIG. 3, both an inlet 40*a* of the oil passage 40 for the high compression ratio and an inlet 41*a* of the oil passage 41 for the low compression ratio are connected to a switching valve 45 through pipes 43 and 44, respectively. The switching valve 45, which is an electrically driven rotary valve having a solenoid 45*a* in the illustrated embodiment, supplies oil pressurized by an oil pump 46 to either the oil passage 40 or the oil passage 41. The switching valve 45 rotates in the direction shown by an arrow in the Figure when the solenoid 45*a* is energized.

Reference numeral 47 denotes an electrically driven valve which obtains an oil pressure sufficient to move the lock pin 30 by a temporary interruption of an oil supply to another valve system (not shown) when the switching valve 45 is driven.

Reference numeral 48 denotes an oil tank.

The valves 45 and 47 are operated by a control circuit 50, described hereafter, as follows. In the state illustrated in FIG. 1, the oil pressure produced by the oil pump 46 is transmitted to the oil passage 40 for the high compression ratio (FIG. 3) through the switching valve 45, the pipe 43, and the inlet 40*a*. In this state, the oil passage 41 for the low compression ratio is communicated with the oil tank 48 through the inlet 41*a* and the pipe 44, and therefore, the oil pressure from the oil pump 46 acts on the lower end of the lock pin 30 through the oil passage 23*e* in the connecting rod 23 when the groove 37 is connected to the groove 31 in the connecting rod 23 via the oil passage 25*a*. On the other hand, the oil pressure in the hole 28 and the oil passages 27*c* and 23*f* is released to the tank 48 through the following route: Namely, during the rotation of the crankshaft 25, when the groove 32 in the connecting rod 23 is communicated with the groove 38 in the part 20' via the oil passage 25*a*, as shown in FIG. 3, the hole 28 is communicated with the oil passage 20*c* via the oil passages 27*c* and 23*f*, and thus the above pressure is released to the tank 48 through the oil passage 41, the pipe 44, and the switching valve 45. Consequently, the increase in oil pressure acting on the lower end of the lock pin 30, and the release of the oil pressure acting on the upper end thereof, cause the lock pin 30 to be urged upwards against the piston pin 24, to thereby cause the lock pin 30 to slide into the hole 28 due to the alignment of the holes 28 and 29 and the bearing 27 to be locked with the connecting rod 23. Therefore, in the above locked state, the portion 27*b* having the largest thickness of the bearing 27 is positioned below the piston pin 24, causing the piston pin 24 to be positioned higher than when the portion 27*b* is positioned above the piston pin 24, i.e., the effective length of the connecting rod 23 increased, and a high compression ratio of the engine is obtained.

To change the high compression ratio to the low compression ratio, both the solenoid 45*a* of the switching valve 45 and a solenoid 47*a* of the valve 47 are energized, and in this case, due to the rotation of the switching valve 47, the oil pressure from the oil pump 46 is transmitted to the oil passage 41 (FIG. 3) through the switching valve 45, the pipe 44, and the inlet 41*a*, but the oil passage 40 for the high compression ratio is communicated with the oil tank 48 through the inlet 40*a* and the pipe 43. Consequently, in this state, when the groove 38 associated with the oil passage 41 is connected to the groove 32 in the connecting rod 23 through the oil passage 25*a*, the increased oil pressure in the oil passage 41 acts on the upper end of the lock pin 30 through the oil passages 23*f* and 27*c* and the hole 28, but the oil pressure in the hole 29 is released to the oil tank 48 when the groove 31 is communicated with the groove 37 via the oil passage 25*a*. Accordingly, the increase in the oil pressure acting on the upper end of the lock pin 30 and the release of the oil pressure acting on the lower end thereof cause the lock pin 30 to be urged downwards against the hole 29, thereby causing the lock pin 30 to slide into the hole 29 due to the alignment of the hole 28 and the hole 29, to allow the bearing 27 to freely rotate in the bore 23*a*. Consequently, when the piston 22 is substantially at TDC, whereat the connecting rod 23 exerts the strongest upward force on the bearing 27, the eccentric bearing 27 occupies a most stable position in which the portion 27*b* having the largest thickness of the bearing 27 is located above the piston pin 24. Therefore, in the unlocked state, the position of the piston pin 24 in the bore 23*a* is lower than when the portion 27*b* is below the piston pin 24, i.e., the effective length of the connecting rod 23 is reduced, and thus a low compression ratio of the engine is obtained.

As described above, this embodiment provides the eccentric bearing 27 illustrated in FIG. 2 and FIG. 3, and further, provides the lock-pin 30 which is fitted or not fitted into the bearing 27 to obtain either a high or a low compression ratio of the engine, as desired.

In addition, the electrically driven valve 47 provides an oil pressure sufficient to move the lock pin 30 by a temporary interruption of the oil supply to another valve system, such as an camshaft (not shown), to thereby ensure a change from one compression ratio to the other, and when the desired compression ratio is obtained, the valve 47 and the switching valve 45 are simultaneously deenergized and opened, and thus the oil supply to the other valve system is resumed.

Referring to FIG. 1, the control circuit 50 controls the operation of the mechanism for varying the compression ratio of the engine by detecting the driving condition thereof, and further, controls the ignition timing so that it is suitable for an actual compression ratio detected by the compression ratio detecting means, such as the combustion pressure sensor or the piston position sensor. Further, according to the present invention, in addition to the above operations, the control circuit 50 detects whether or not the compression ratio detecting means has malfunctioned, and additionally, varies and fixes the present compression ratio to a lower value if the compression ratio detecting means has malfunctioned. Preferably, the current ignition timing is delayed, to further decrease the knocking.

The control circuit 50 is constructed as a microcomputer system and comprises a microprocessor (CPU) 51, a read-only memory (ROM) 52, a random access memory (RAM) 53, an input/output port 54, an analog/digital converter 55, and a bidirectional bus 57 interconnecting the above elements to each other. In the embodiment illustrated in FIG. 1, to detect the current engine driving conditions, a first crank angle sensor 56 and a second crank angle sensor 57 are provided in the distributor 19. The first crank angle sensor 56 is positioned in the vicinity of a disc-like rotating piece 58 on a distributor shaft 19*a*, to thereby generate a pulse signal (NE) at a predetermined rotating angle of the crankshaft 25, for example, 30°. This pulse signal NE is used by the control circuit 50 to detect an engine speed NE. The second crank angle sensor 57 is positioned in the vicinity of another disc-like rotating piece 59 on the distributor shaft 19*a*, to thereby generate another pulse signal G at a predetermined rotating angle of the crankshaft 25, for example, 720°. This pulse signal G is used by the control circuit 50, as a reference signal. Furthermore, to detect the current engine load, a vacuum sensor 18 is provided in the intake pipe 16 and generates an analog signal level corresponding to an intake pressure PM. These sensors 18, 56, and 57 are well-known by those skilled in this art. Also, as other parameters of the engine load, a ratio Q/NE of an intake air volume Q to the engine speed NE or an opening degree TA of a throttle valve (not illustrated) may be used instead of the intake pressure PM.

In the illustrated embodiment, combustion pressure sensors 61 are provided in the cylinder head 21 as the compression ratio detecting means, and are disposed so that the sensing face thereof is open into each combustion chamber 12 in the cylinder head 21. Each combustion pressure sensor 61 generates an analog signal level corresponding to a combustion pressure P of each combustion chamber 12. Note, of course, the piston position sensors to detect the position of the piston 22 at TDC (not illustrated) may be used instead of the combustion pressure sensors 61, as another compression ratio detecting means.

The first and second crank sensors 56 and 57 generate digital pulse signals NE and G which are input to the control circuit 50 at predetermined intervals through the input/output port 54, respectively. The vacuum sensor 18 generates an analog output signal level which is input to the analog/digital converter 55, wherein the analog output level PM is converted into a digital signal. Similar to the vacuum sensor 18, the combustion pressure detecting sensors 61 also generate an analog signal level P which is input to the analog/digital converter 55 through peak-hold circuits 63 to hold a maximum level of a varying combustion pressure in one combustion cycle with respect to each combustion chamber 12.

The control circuit 50 executes calculation programs, described after, in response to the engine driving conditions detected by the above-mentioned sensors, and outputs signals to control the mechanism for varying the compression ratio of the engine, and outputs pulses for igniting the engine from the input/output port 54. As shown in FIG. 1, an ignition control device 66 comprises a not shown ignition control circuit connected to the input/output port 54 to receive output pulses, and a not shown ignition coil connected to the distributor 19 to supply electric power to each spark plug 14 in accordance with the rotation of the distributor shaft 19*a*. The solenoids 45*a* and 47*a* of the valves 45 and 47 are also connected to the input/output port 54, and thus the valves 45 and 47 are electrically driven by signals output by the control circuit 50 for changing the compression ratio. The programs for executing the operations of the above mechanism and the ignition control device 66 are stored in a predetermined area of the ROM 52.

Figures 4, 4A:
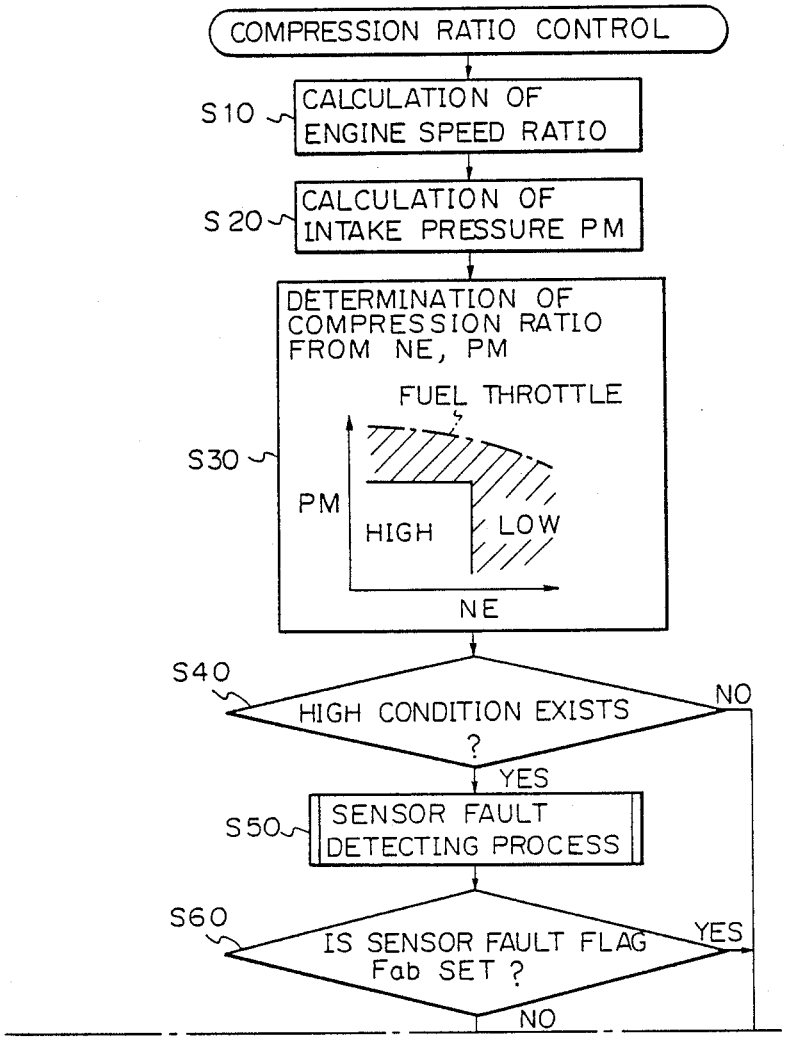
FIG. 4, comprising
FIGS. 4A–4C, is a flow chart of the routine carried out by a control circuit according to the present invention.
Figure 4B:
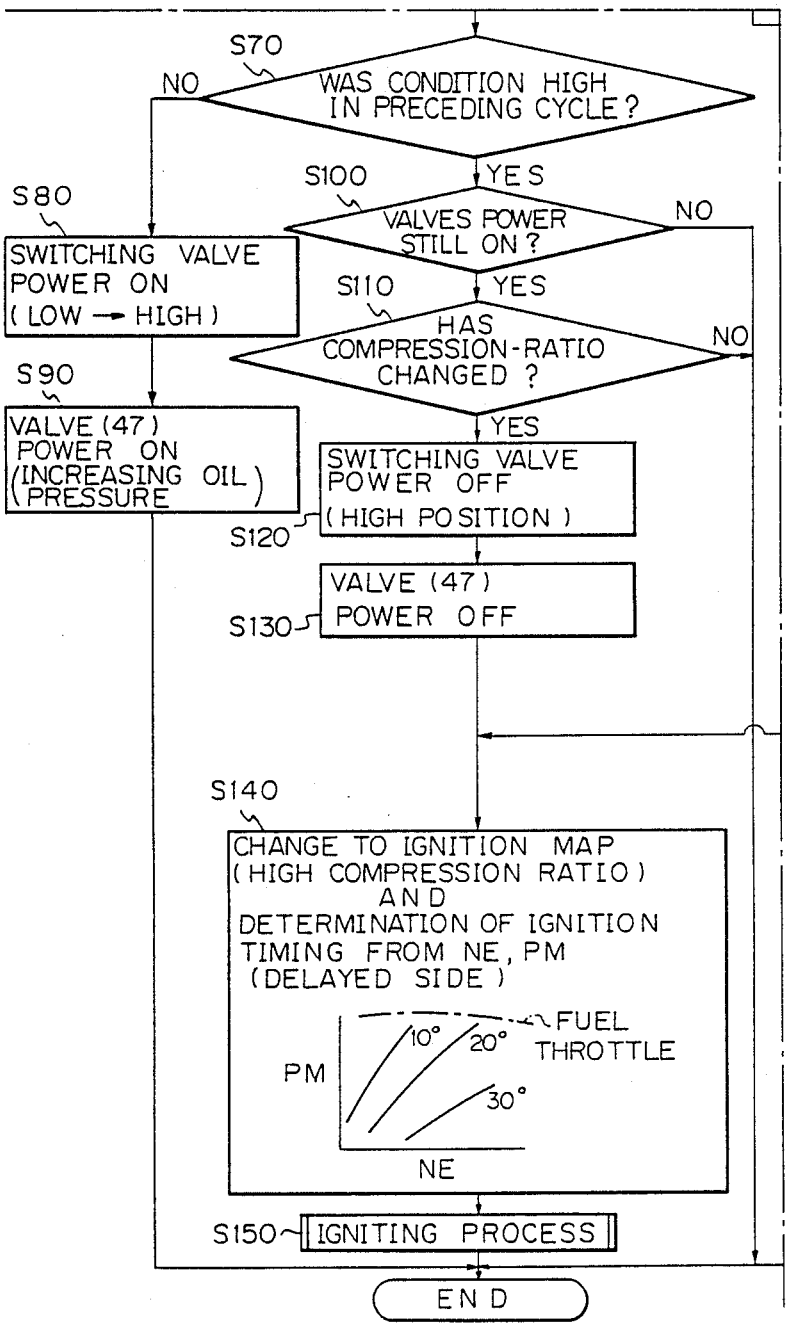
Figure 4C:
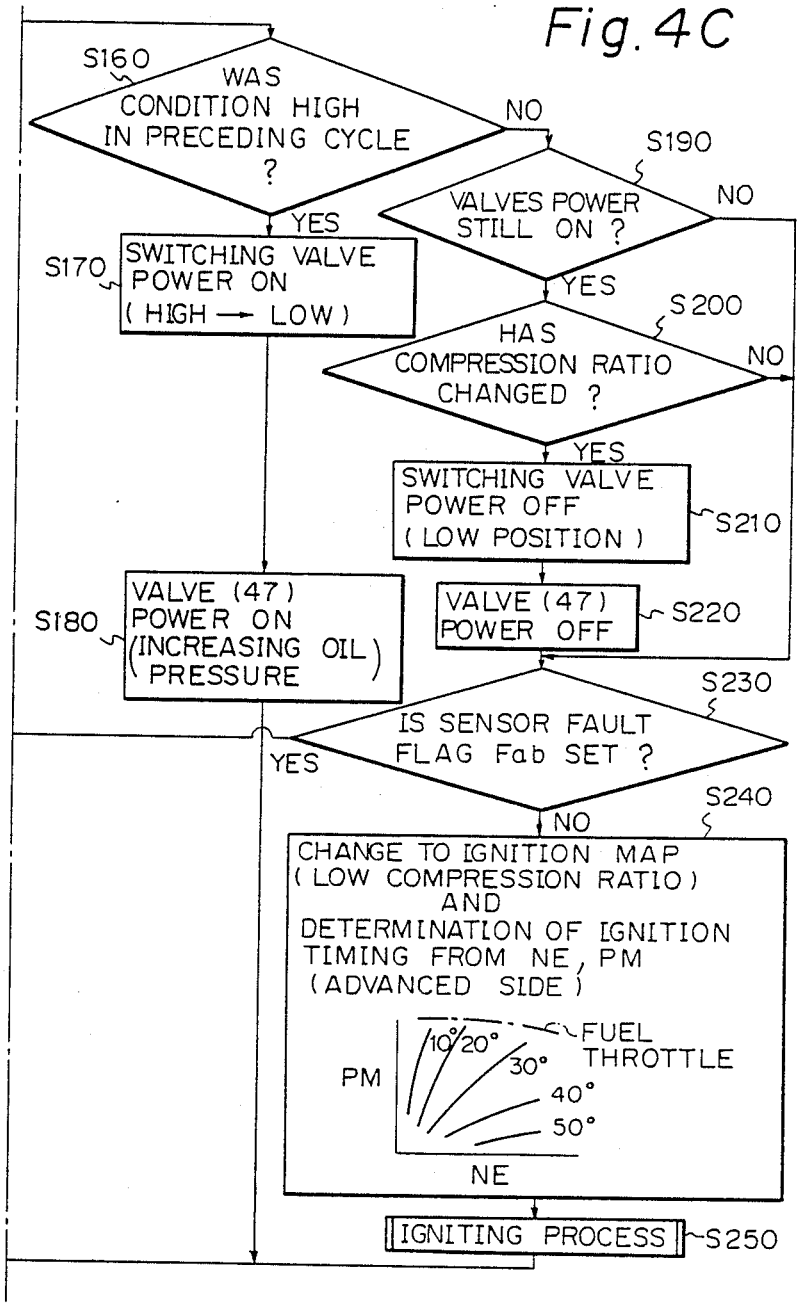

FIG. 4 is a flow chart for explaining the execution of the compression ratio control, which is started at a predetermined interval, such as a predetermined crank angle or timing. Referring to FIG. 4, at step S10, the engine speed NE is calculated from the output pulse of the first crank angle sensor 56, and then, at step S20, the intake pressure PM is calculated from the output signal level of the vacuum sensor 18. Accordingly, the current driving condition of the engine, i.e., the engine load, is determined at the above steps S10 and S20, and then, at step S30, it is determined whether the compression ratio is high or low, from the calculated engine speed NE and the intake pressure PM. Namely, a predetermined map in the ROM 52 shown in FIG. 1, is used to select either the high or low compression ratio in correspondence with the result of the calculation of the engine speed NE and the intake pressure PM, and thus an appropriate compression ratio is determined in the CPU 51. Then, at step S40, it is determined whether the compression ratio obtained in step S30 is high, i.e., at step S40, it is determined whether the current driving condition is under a low engine load for which the compression ratio should be changed to a high compression ratio, (hereinafter referred to as the "high condition") or under a high engine load for which the compression ratio should be changed to a low compression ratio, (hereinafter referred to as the "low condition").

If YES at step S40, the program goes to step S50 to execute another program to determine whether or not the combustion pressure sensor 61 has malfunctioned; this program will be described after. Then, at step S60, it is determined whether the sensor fault flag Fab is set. If the sensor fault flag Fab is reset, the routine goes to step S70, and it is determined whether the driving condition determined in the preceding processing cycle was a high condition. If NO at step S70, i.e., if the high condition was initially obtained in the current processing cycle, the program goes to step S80, and the switching valve 45 is rotated. Namely, at step S80 the switching valve 45 is rotated to a new position illustrated in FIG. 1, and the high compression ratio is obtained by energizing the solenoid 45*a* by a signal from the input/output port 54 of the control circuit 50. Then, at step S90, the valve 47 is closed to obtain an oil pressure sufficient to move the lock pin 30, to thereby ensure the change from the low compression ratio to the high compression ratio.

If YES at step S70, i.e., if the high condition has continued from the preceding processing cycle, the program goes to step S100 and it is determined whether both the switching valve 45 and the valve 47 are still energized, i.e., whether the processor changing the compression ratio is now being executed in the present processing cycle. If NO at step S100, the remaining steps in the routine are bypassed and the routine ended, since the No result means that the switching valve 45 is already in the new position (hereinafter referred to as "the high position") and a high compression ratio can be obtained. Conversely, if YES at step S100, the routine goes to step S110 to determine whether a high compression ratio has been just realized, by detecting the output signal level from the combustion pressure sensor 61. If NO at step S110, i.e., if the high compression ratio has not been obtained the remaining steps in the routine are bypassed and the routine ended. If YES at step S110, the routine goes to step S120 and the following step S130 to deenergize the switching valve 45 and the valve 47. Then, at step S140, the ignition timing is determined from the calculated engine speed NE and the intake pressure PM by using an ignition-timing map, in which each ignition timing is delayed to reduce the knocking in the high compression ratio condition. Then, at step S150, the ignition process is executed at the ignition timing determined in step S140.

Returning to step S60, if the sensor fault flag Fab is set, the process for obtaining the low compression ratio is executed at the following steps, as a fail-safe process. The following steps are the same as the steps which will be executed if the result at step S40 is NO, i.e., the low condition exists. Then, at step S160, it is determined whether the driving condition determined in the preceding processing cycle was a high condition. If YES at step S160, i.e., if the low condition was initially obtained in the current processing cycle, the routine goes to step S170. Then, at step S170, the switching valve 45 is rotated. Namely, at step S170 the switching valve 45 is rotated to a new position, and the low compression ratio is obtained by energizing the solenoid 45*a* by a signal from the input/output port 54 of the control circuit 50. Then, at step S180, the valve 47 is closed to obtain an oil pressure sufficient to move the lock pin 30, to thereby ensure the change from the high compression ratio to the low compression ratio.

If NO at step S160, i.e., if the low condition has continued from the preceding processing cycle, the routine goes to step S190 and it is determined whether the switching valve 45 and the valve 47 are both still energized, i.e., whether the process for changing the compression ratio is being executed in the current processing cycle. If NO at step S190, the routine goes directly to step S230, since the No result means that the switching valve 45 is already in the new position (hereinafter referred to as "the low position"), and thus the low compression ratio can be obtained. If YES at step S190, the routine goes to step S200 and it is determined whether a low compression ratio has been just obtained by detecting the output levels from the combustion pressure sensor 61. If NO at step S200, i.e., if the low compression ratio has not been obtained, the routine goes directly to step S230. If YES at step S200, the routine goes to step S210 and the following step S220 to deenergize the switching valve 45 and the valve 47. Then, at step S230, it is again determined whether the sensor fault flag Fab is set, i.e., whether the low compression ratio obtained in the current processing cycle is due to a fault in the combustion pressure sensor 61 or to a normal compression ratio control corresponding to a change of the driving conditions. If NO at step S230, the routine goes to step S240 and it is determined whether the ignition timing has been obtained from the calculated engine speed NE and the intake pressure PM by using an ignition timing map, in which the ignition timing is advanced for the low compression ratio. Then, at step S250, the ignition process is executed at the ignition timing obtained in step S240. If YES at step S230, the routine goes to step S140 and the ignition timing is determined by using the ignition timing map for the high compression ratio, which enables a remarkable decrease in the knocking, in addition to a change to the low compression ratio as a fail-safe measure.

As mentioned above, the compression ratio control routine in this embodiment is intended to change the compression ratio and the ignition timing, but as another embodiment, a compression ratio control by which only the compression ratio is changed may be used, to decrease the knocking. Note, when the above embodiment is used, step S230 is deleted from the routine thereof.

Figure 5:
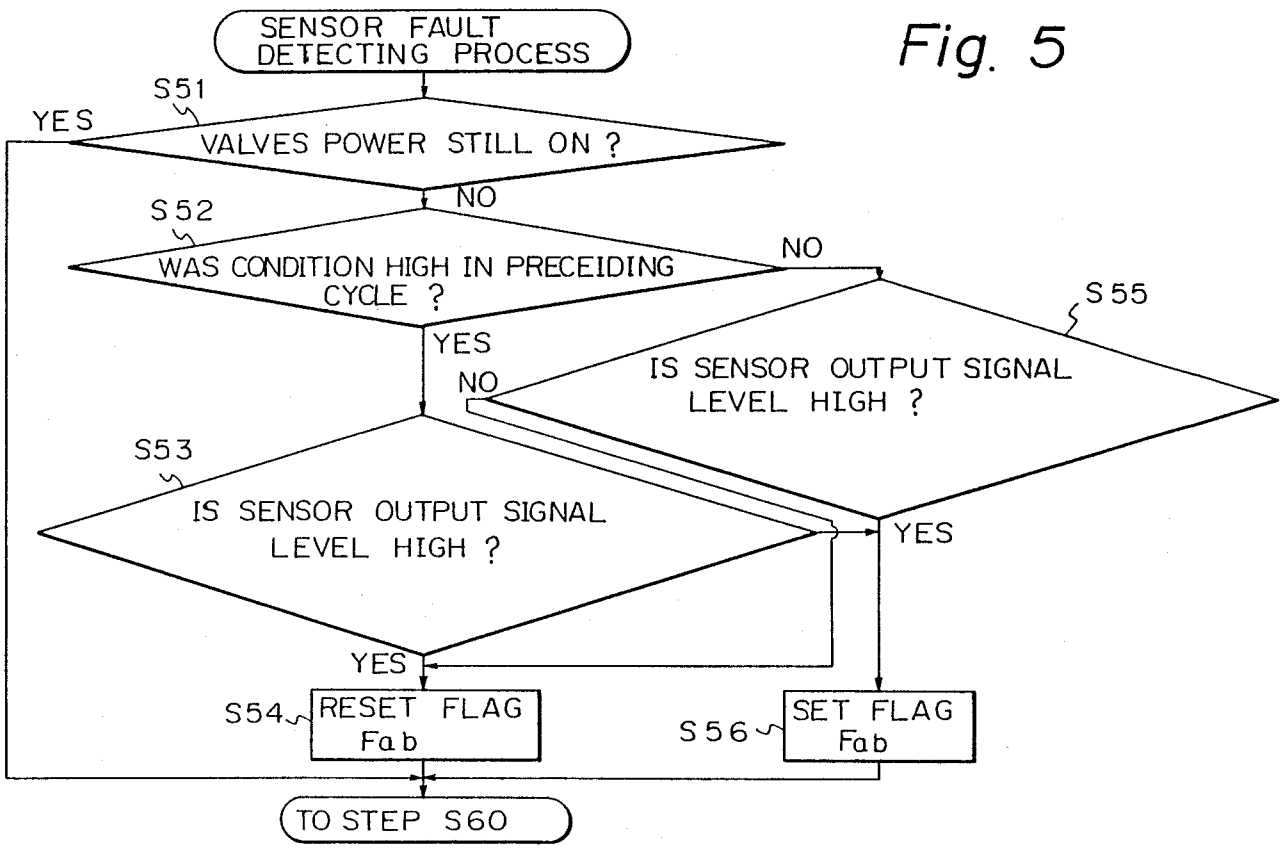
FIG. 5 is a flow chart of the routine carried out in step S50 in FIG. 4.

FIG. 5 is a flow chart for explaining the execution of the routine for determining whether or not the combustion pressure sensor 61 has malfunctioned, as shown at step S50 of FIG. 4. This flow chart also is started at the same predetermined intervals as the intervals of the flow chart of FIG. 4. Referring to FIG. 5, at step S51, it is determined whether the process for changing the compression ratio is now being executed. If YES at step S51, the routine goes directly to step S60, but, if the result is NO at step S51, i.e., if the switching valve 45 is in either the high position or the low position, the routine goes to step S52 and it is determined whether the driving condition in the preceding processing cycle was a high-condition in which the compression ratio should be changed to a high compression ratio. If YES at step S52, the routine goes to step S53, but if NO at step S52, the routine goes to step S55. At steps S53 and S55, it is determined whether or not the present compression ratio is a high compression ratio, by detecting the output signal level of the combustion pressure sensor 61. If NO at step S53, i.e., if the present compression ratio is determined to be a low compression ratio; although the result at step S52 was YES, the routine goes to step S56 and is determined that the combustion pressure sensor 61 has malfunctioned. Accordingly, at step S56, the sensor fault flag Fab is set. Similarly, if YES at step S55, i.e., if the current compression ratio is determined to be a high compression ratio, although the result at step S52 was NO, the routine goes to step S56 and the sensor fault flag Fab is set. On the other hand, if the driving condition in the preceding processing cycle is in accordance with the output levels of the combustion pressure sensor 61, i.e., if the result at step S53 was YES or if the result at step S55 was NO, the routine goes to step S54 and it is determined that the combustion pressure sensor 61 has not malfunctioned. Then, at step S54, the sensor fault flag Fab is reset, and the routine goes to step S60 in FIG. 4A.

Further, according to the sensor fault detecting program mentioned above, the sensor fault flag Fab will be set when a malfunction occurs in the mechanism for varying the compression ratio, for example, in the switching valve 45 or the valve 47, as well, by comparing the actual driving condition with the output signal level of the sensor 61, and thus a malfunction of the mechanism can be discovered at an early stage.

Figure 6:
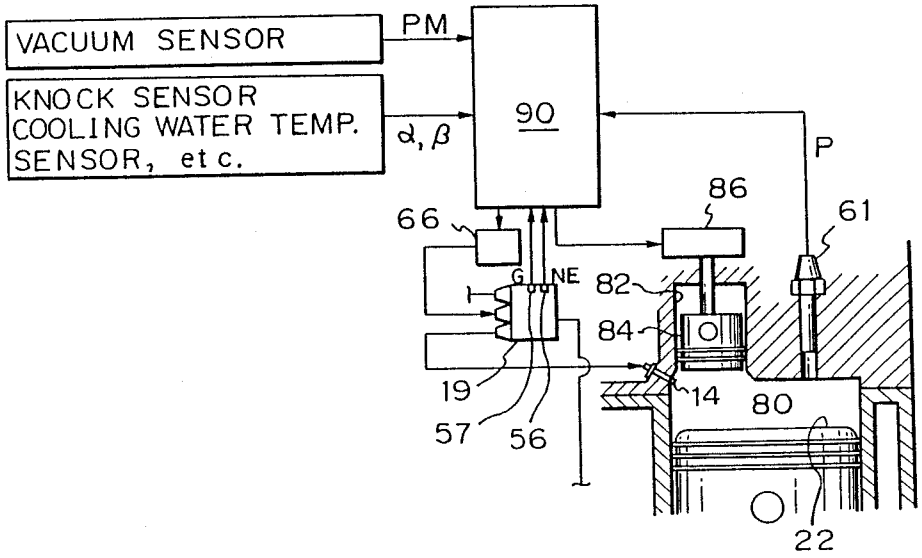
FIG. 6 is a schematic view of an internal combustion engine to which a variable compression ratio control device according to a second embodiment of the present invention is applied.

As described above, the first embodiment of the present invention is directed to a mechanism for varying the compression ratio in two stages, i.e., a high and a low compression ratio. In addition, the present invention can be applied to a mechanism for varying a compression ratio of an engine by continuous stages or by multistages, i.e., more than two stages. FIG. 6 is a schematic view including the above mechanism for varying the compression ratio in continuous stages or in multistages, and a compression ratio control device of the engine.

Referring to FIG. 6, a sub-combustion chamber 82 in which a sub-piston 84 is slidably disposed is provided above a combustion chamber 80. The sub-piston 84 is driven by a piston-drive unit 86 controlled by a control circuit 90 in correspondence with the driving conditions of the engine, thereby causing the capacity of a combustion chamber 80, i.e., the compression ratio of the engine to be varied in continuous stages or in multistages. In FIG. 6, 19 designates a distributor, 14 a spark plug, 61 a combustion pressure sensor, 66 an ignition circuit, and 56 and 57 crank angle sensors.

Figures 7, 7A:
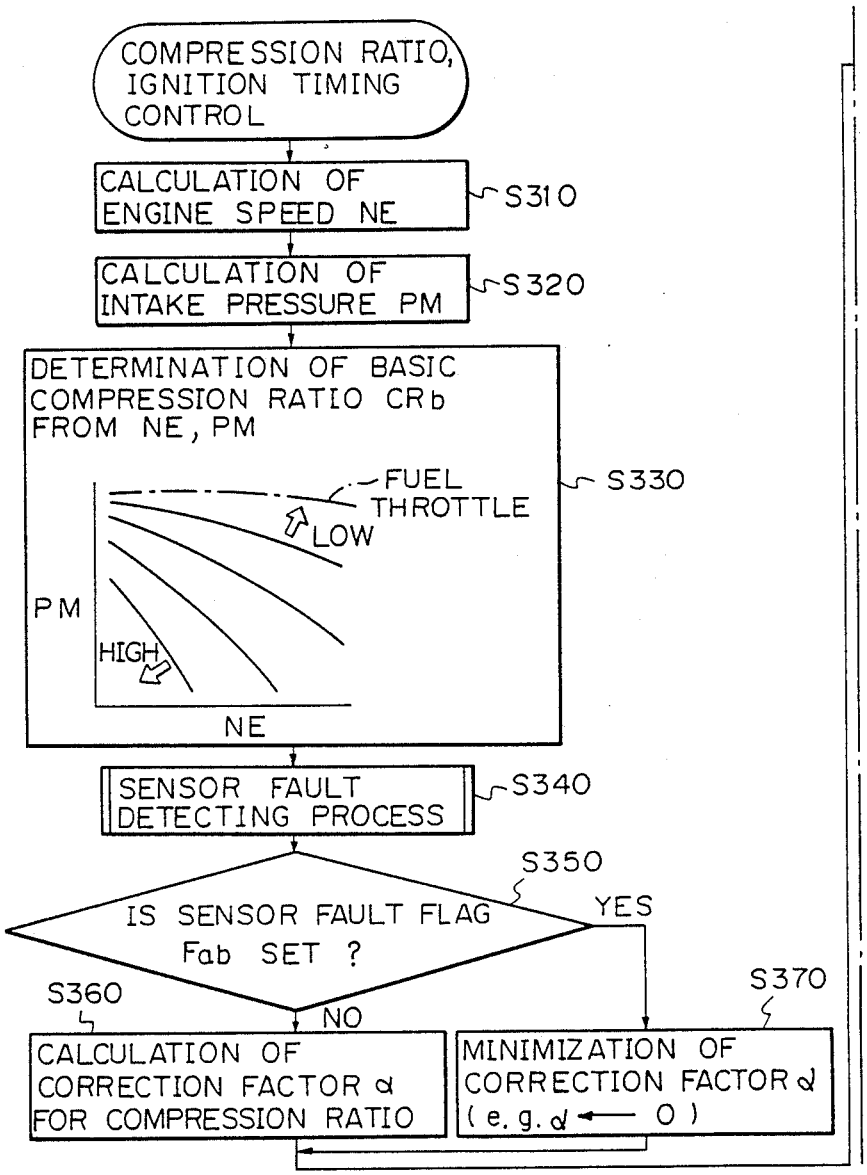
FIG. 7, comprising
FIGS. 7A–7C, is a flow chart of the routine carried out by a control circuit in FIG. 6; and, FIG. 8 is a flow chart of the routine carried out in step S340 in FIG. 6.
Figure 7B:
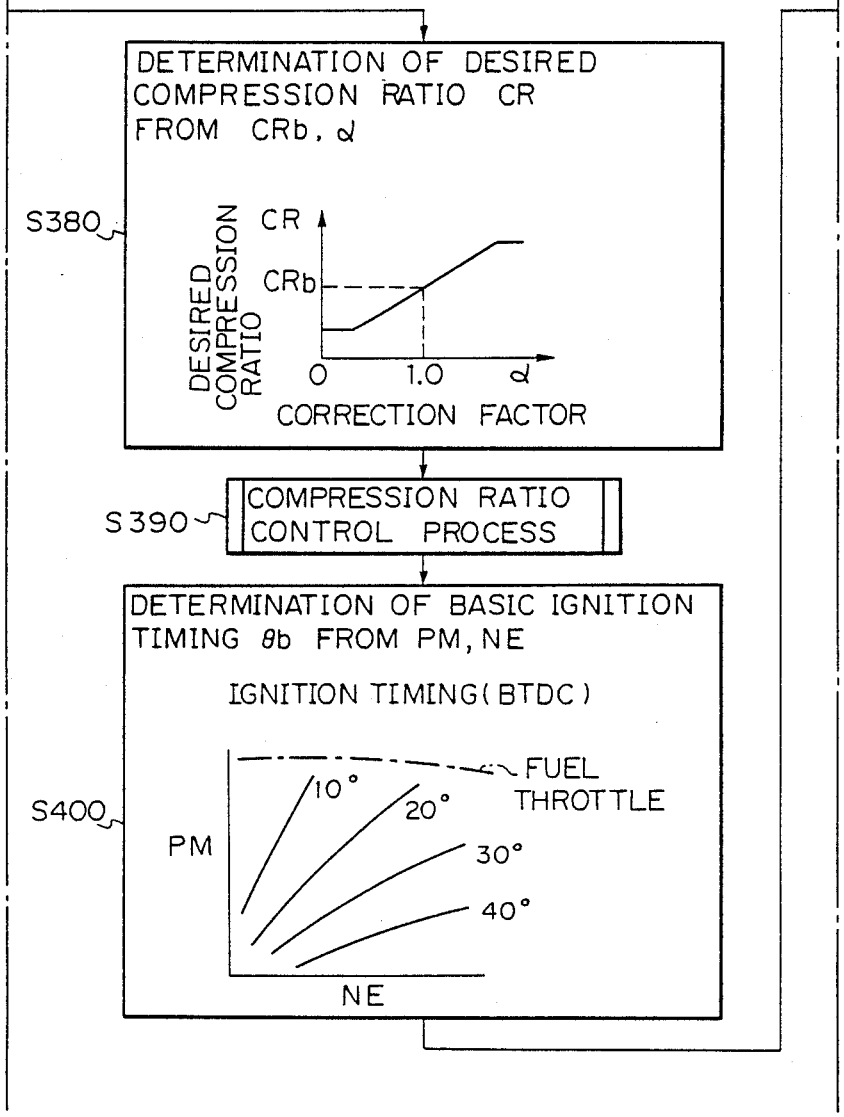
Figure 7C:
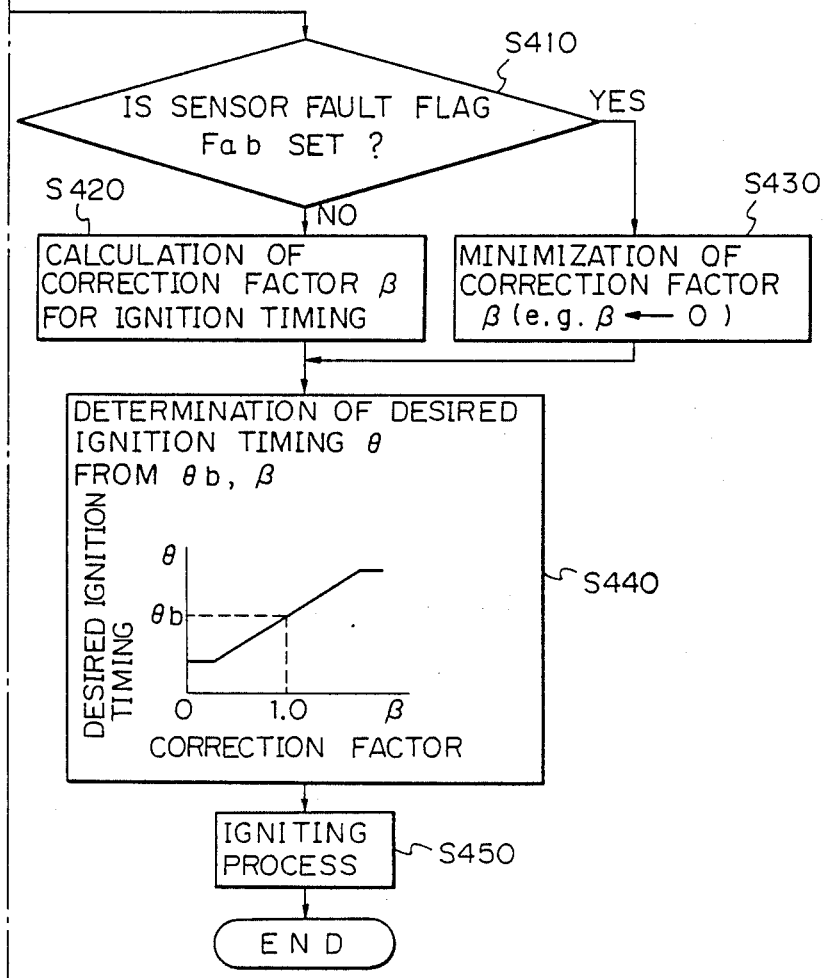

FIG. 7 is a flow chart for explaining the execution of the compression ratio control of the engine in which the mentioned mechanism for varying the compression ratio in multistages is fitted. This flow chart starts at predetermined intervals, such as a predetermined crank angle or timing, as in the flow chart of FIG. 4. Referring to FIG. 7, at step S310, the engine speed NE is calculated from the output pulse of the crank angle sensor 56, and then, at step S320, the intake pressure PM is calculated from the output signal level of the vacuum sensor 18. Then, at step S330, a basic compression ratio CRb, which will be corrected in correspondence with other driving condition factors and a determination of whether or not the combustion pressure sensor has malfunctioned, is determined from the calculated engine speed NE and the calculated intake pressure PM. Namely, at step S330, the basic compression ratio determining process is executed by using a predetermined map, in which various basic compression ratios are preset over multistages in accordance with the engine loads detected.

Then, at step S340, an program for determining whether or not the combustion pressure sensor 61 has malfunctioned is executed. This program will be described later. Then, at step S350, it is determined whether the sensor fault flag Fab is set.

In general, in the mechanism for varying the compression ratio in a continuous stage or in multistages, the basic compression ratio CRb determined at step S330 is normally corrected by a correction factor $\alpha$, which relies on values detected by an engine parameter-detecting means such as a knock sensor or a cooling water temperature sensor, whereby the engine is driven in such a manner that the compression ratio thereof is in accordance with current driving conditions. Therefore, if NO at step S350, i.e., if the flag Fab is not set, the routine goes to step S360 and correction factor $\alpha$ is calculated from outputs of the knock sensor and/or the cooling water temperature sensor. Then, at step S370, a desired compression ratio CR is determined by, for example, searching a correction map. Of course, the correcting process executed in step S380 is not limited to the above map search but, for example, the process may be executed by the addition to or subtraction from the correction factor $\alpha'$ at the determined basic compression ratio CRb. Returning to step S350, if the result is YES, i.e., if the combustion pressure sensor 61 in this embodiment has malfunctioned, the routine goes to step S370 and a process for varying the compression ratio to the lower side is executed. Therefore, in this embodiment employing the described map search, the process for minimizing the correction factor $\alpha$ to zero is executed at step S370. Also, referring to the above process, in the case of an addition or subtraction of the correction factor $\alpha'$, the varying process may be executed by subtracting a maximum correction factor from the basic compression ratio CRb.

Then, at step S380, the desired compression ratio CR is calculated from the basic compression ratio CRb and the correction factor $\alpha$ or $\alpha'$, and at step S390, the control circuit 90 generates output signal level to drive the piston-drive unit 86, to thereby cause the sub-piston 84 to slide to a position at which the desired compression ratio CR is obtained. Next, at step S400, a basic ignition timing $\theta b$ is determined from the calculated engine speed NE and the calculated intake pressure PM by, for example, using a basic ignition timing map. Then, at step S410, it is determined whether the sensor fault flag Fab is set. As well as the basic compression ratio, the basic ignition-timing $\theta b$ is also corrected by a correction factor $\beta$ which varies in correspondence with the current engine conditions. Therefore, if NO at step S410, the routine goes to step S420 and the correction factor $\beta$ is determined from outputs of the engine condition detecting means. Then, at step S440, a desired ignition timing $\theta$ is determined by, for example, a map search of a correction map. On the other hand, if YES at step S410, the routine goes to step S430 to execute a process for shifting the current ignition timing to the delayed side, i.e., to minimize the correction factor $\beta$ to zero in the correction map, to thereby decrease the knocking. At step S450, the control circuit 90 generates output signals to the ignition circuit 66, to thereby cause ignition of the spark plug 14 at the desired ignition-timing $\theta$ determined at step S440. Referring to the correction process at step S430, when the process is executed by the addition or subtraction of correction angles $\beta'$ at the basic ignition timing $\theta b$, the process at step S430 is executed by subtracting a maximum correction angle $\beta'$ from the basic ignition timing $\theta b$.

Figure 8:
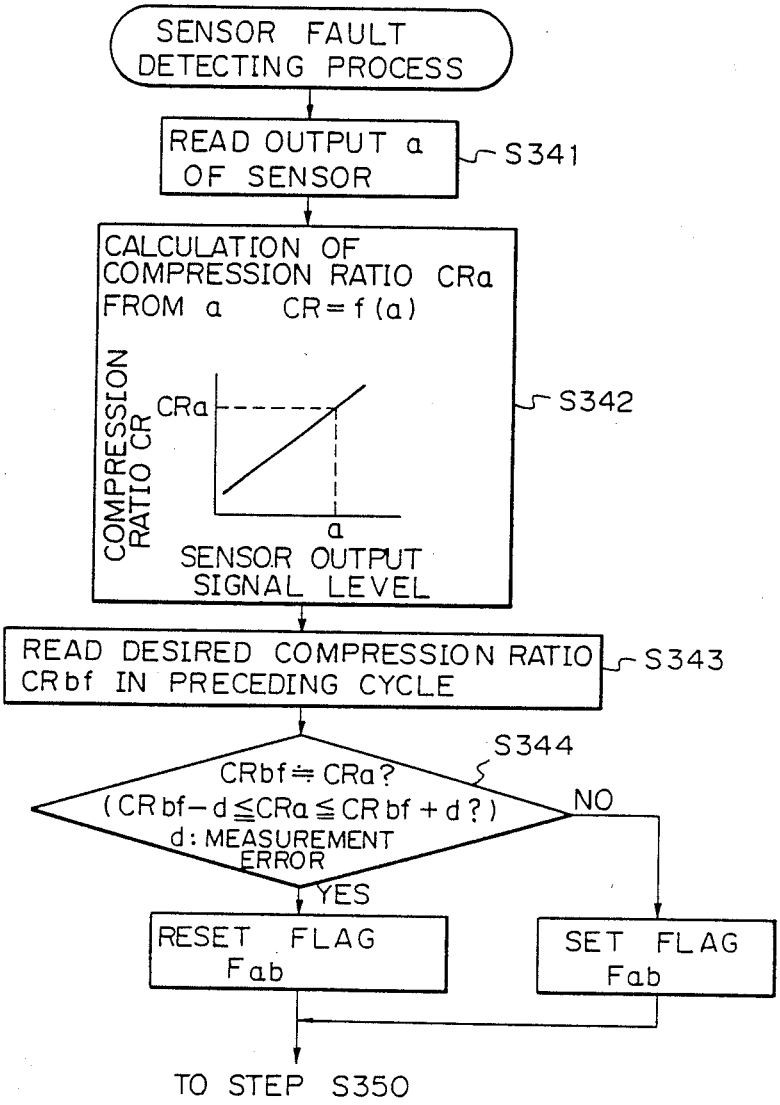

FIG. 8 is a flow chart for explaining the execution of the program for determining whether or not the combustion pressure sensor 61 has malfunctioned, as shown at step S340 of FIG. 7. This flow chart is also started at the same predetermined intervals as the intervals of the flow chart of FIG. 7.

Referring to FIG. 8, at step S341, the current output signal level a of the combustion pressure sensor 61 is detected, and at step S342, a compression ratio CRa corresponding to the detected level a is calculated from an experimentally preset map shown at step S342. Then, at step S343, the desired compression ratio CRbf determined at step S380 in the preceding processing cycle is read, and at step S344, it is determined whether the CRbf is substantially equal to the calculated CRa. Preferably, the determination is made while taking into consideration measurement errors d obtained experimentally. In detail, at step S344, it is determined whether the calculated CRa is between a value of CRbf+d and a value of CRbf−d. If YES at step S344, the routine goes to step S345 and the sensor fault flag Fab is reset, but if the result is NO, the routine goes to step S346 and the sensor fault flag Fab is set. Then, finally, the routine goes to step S350 in FIG. 7.

As mentioned above, in this second embodiment the compression ratio and the ignition timing are both varied, as in the first embodiment, but as another embodiment, a compression ratio control in which only the compression ratio is varied, may be used to decrease the tendency of knocking. If this embodiment is employed, steps S410 and S430 are not included in the routine thereof.

According to the present invention, as mentioned above, the increase of knocking, and resultant damage to the engine can be prevented by changing the current compression ratio to a lower value when the compression ratio detecting means has malfunctioned.

Of course, many modifications and changes can be made by those skilled in this art without departing from the scope and the spirit of the invention.

We claim:

1. A variable compression ratio control device for an internal combustion engine having a mechanism for varying a compression ratio of the engine in response to engine driving conditions, at least between a first higher stage and a second lower stage, and detecting a current compression ratio; said device comprising;

sensor fault detecting means for detecting a malfunction of said compression ratio detecting means, and fail-safe means for varying and fixing a compression ratio to said second lower stage when said sensor fault detecting means detects a malfunction of said compression ratio detecting means.

2. A device according to claim 1, wherein said fail-safe means further varies an ignition timing by delaying same, in addition to varying and fixing the compression ratio.

3. A device according to claim 1, wherein said sensor fault detecting means detects a malfunction of said compression ratio detecting means by comparing a compression ratio calculated from an engine load with an output signal level from said compression ratio detecting means.

4. A device according to claim 1, wherein said mechanism varies the compression ratio between two stages of a high compression ratio and a low compression ratio in response to driving conditions.

5. A device according to claim 1, wherein said mechanism varies the compression ratio in a continuous stage or in multistages of more than two stages.

6. A device according to claim 4, wherein said fail-safe means varies and fixes the compression ratio to the low compression ratio when said sensor fault detecting means detects a malfunction of said compression ratio detecting means.

7. A device according to claim 5, wherein a compression ratio determined in response to driving conditions is a basic compression ratio, and said basic compression ratio is corrected by a correction factor $\alpha$ having a values derived from an engine driving parameter different from the engine load.

8. A device according to claim 7, wherein said fail-safe means varies and fixes said correction factor $\alpha$ in such a manner that said basic compression ratio is lowered when said sensor fault detecting means detects a malfunction of said compression ratio detecting means.

9. A device according to claim 1, wherein said compression ratio detecting means includes a combustion pressure sensor for detecting a combustion pressure which corresponds to a compression ratio of the engine.

10. A device according to claim 1, wherein said compression ratio detecting means includes piston position sensors for detecting a TDC position of a piston which corresponds to a compression ratio of the engine.

* * * * *